US011587545B2

(12) United States Patent
Lee et al.

(10) Patent No.: US 11,587,545 B2
(45) Date of Patent: Feb. 21, 2023

(54) REFRIGERATOR WITH COMPRESSOR NOISE REDUCTION

(71) Applicant: LG Electronics Inc., Seoul (KR)

(72) Inventors: Jongchan Lee, Seoul (KR); Youngeun Cho, Seoul (KR); Sunghyun Ki, Seoul (KR); Goondong Park, Seoul (KR); Geunbae Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 140 days.

(21) Appl. No.: 17/113,491

(22) Filed: Dec. 7, 2020

(65) Prior Publication Data

US 2021/0193106 A1 Jun. 24, 2021

(30) Foreign Application Priority Data

Dec. 24, 2019 (KR) ..... 10-2019-0174252

(51) Int. Cl.
*G10K 11/178* (2006.01)

(52) U.S. Cl.
CPC .... *G10K 11/17873* (2018.01); *F25D 2201/30* (2013.01); *G10K 2210/1054* (2013.01); *G10K 2210/3027* (2013.01); *G10K 2210/3044* (2013.01); *G10K 2210/3046* (2013.01)

(58) Field of Classification Search
CPC ..... G10K 11/17873; G10K 2210/1054; G10K 2210/3027; G10K 2210/3044; G10K 2210/3046; F25D 2201/30
USPC ..... 62/296; 381/71.3
See application file for complete search history.

(56) References Cited

U.S. PATENT DOCUMENTS 4,989,252 A * 1/1991 Nakanishi ..... G10K 11/17861 381/71.3
5,125,241 A * 6/1992 Nakanishi ..... G10K 11/17854 381/71.11

FOREIGN PATENT DOCUMENTS

| | | |
|---|---|---|
| CN | 102022892 | 4/2011 |
| EP | 1450120 | 8/2004 |
| JP | H02103366 | 4/1990 |
| JP | H02225967 | 9/1990 |
| JP | H06094349 | 4/1994 |
| JP | 2008210342 | 9/2008 |
| JP | 2008257311 | 10/2008 |
| JP | 2008257312 | 10/2008 |
| KR | 1019930004402 | 3/1993 |

(Continued)

OTHER PUBLICATIONS

English translation of JPH0694349 (A) from Espacenet translated May 18, 2022 (Year: 1994).*

(Continued)

*Primary Examiner* — Paul Kim
*Assistant Examiner* — Douglas J Suthers
(74) *Attorney, Agent, or Firm* — Fish & Richardson P.C.

(57) ABSTRACT

A refrigerator includes a noise reduction device and a machine room that accommodates a condenser and a compressor. The noise reduction device includes a sensing unit configured to measure noise generated from the machine room of the refrigerator and a generating unit configured to output a sound signal having a frequency canceling or reducing the noise. The machine room is defined by a case that has a communication portion configured to communicate a fluid between an inside of the case and an outside of the case to thereby exchange heat between the fluid and the condenser and between the fluid and the compressor.

16 Claims, 8 Drawing Sheets

(56) References Cited

FOREIGN PATENT DOCUMENTS

| | | |
|---|---|---|
| KR | 930008006 | 8/1993 |
| KR | 1020010010605 | 2/2001 |
| KR | 1020050102327 | 10/2005 |
| KR | 1020090048168 | 5/2009 |
| KR | 1020100088231 | 8/2010 |
| KR | 20120135768 | 12/2012 |
| KR | 20170091219 | 8/2017 |

OTHER PUBLICATIONS

Office Action in Chinese Appln. No. 202011410053.2, dated Mar. 14, 2022, 23 pages (with English translation).
KR Office Action in Korean Appln. No. 10-2019-0174252, dated Feb. 10, 2021, 15 pages (with English translation).
EP Extended European Search Report in European Appln. No. 20212680.1, dated May 25, 2021, 8 pages.
KR Notice of Allowance in Korean Appln. No. 10-2019-0174252, dated Apr. 13, 2021, 6 pages (with English translation).

* cited by examiner

REFRIGERATOR WITH COMPRESSOR NOISE REDUCTION

CROSS-REFERENCE TO RELATED APPLICATION

This application claims the benefit of Korean Patent Application No. 10-2019-0174252, filed on Dec. 24, 2019, which is hereby incorporated by reference as if fully set forth herein.

TECHNICAL FIELD

The present disclosure relates to a refrigerator with a noise reduction device.

BACKGROUND

In general, a refrigerator is a device that reduces temperature inside it and stores food frozen or refrigerated by supplying cold air generated on a refrigeration cycle containing a compressor, a condenser, an expansion valve, and an evaporator.

A refrigerator generally includes a freezer compartment for freezing and storing food or beverages, and a refrigerator compartment for storing food or beverages at a low temperature.

Such refrigerators may be classified into a top mount type in which the freezer compartment is disposed on the refrigerator compartment, a side by side type in which the freezer compartment and the refrigerator compartment are divided to the left and right by a wall, and a bottom freezer type in which the freezer compartment is disposed under the refrigerator compartment.

The refrigerator cools a storage room such as the freezer compartment or the refrigerator compartment with cold air generated through exchange of hear with a refrigerant circulating in the refrigeration cycle. Therefore, the insides of the storage rooms in the refrigerator are usually maintained at a lower temperature than the outside.

The freezer compartment and the refrigerator compartment are provided inside cases constituting a refrigerator body and are selectively opened and closed by a freezer compartment door and a refrigerator compartment door, respectively.

The refrigerator further includes a machine room in which the compressor is located. When the machine room is located under a storage room, a condenser may be further located in the machine room. On the contrary, when the machine room is located on a storage room, the evaporator may be further located in the machine room.

However, the compressor located in the machine room generates vibrations and noise. Therefore, a configuration for reducing vibrations and noise generated from the compressor is required.

In this regard, Korean Laid-Open Patent Publication No. 10-2017-0091219 discloses a refrigerator including a resonance device.

The refrigerator according to the prior art may reduce only noise in a specific frequency in view of the nature of the resonance device. However, a rotator rotating inside the compressor generates noise in a different frequency depending on a rotation speed. Therefore, when the speed of the rotator changes, the noise generated from the compressor may not be reduced.

Accordingly, there is a need for a noise reduction device that reduces noise generated from a compressor even when the rotation speed of the compressor changes.

SUMMARY

Provided is a noise reduction device for efficiently reducing noise generated from a refrigerator.

Provided is a noise reduction device for reducing noise generated from a compressor, even when the number of revolutions of the compressor changes.

Provided is a machine room in which an efficient cooling path is formed.

Provided is a refrigerator with a high-efficiency compressor.

Additional aspects will be set forth in part in the description which follows and, in part, will be apparent from the description, or may be learned by practice of the presented embodiments of the disclosure.

According to an embodiment of the disclosure, a refrigerator cancels operating frequencies of 270 Hz and 340 Hz of a compressor.

According to an embodiment of the disclosure, a refrigerator includes two speakers arranged in opposite directions.

The arrangement of the speakers may efficiently cancel noise amplified by horizontal vibrations out of noise of a compressor.

According to an embodiment of the disclosure, a refrigerator includes a machine room with a side surface in which an opening is formed.

According to an embodiment of the disclosure, a refrigerator machine room includes a case accommodating a condenser and a compressor therein, a sensing unit provided located at the case and configured to measure noise from the compressor, and a generator unit provided inside the case and configured to output a sound signal having a frequency configured to cancel or reduce the noise measured from the compressor. A communication portion or portion is formed in the case to communicate the inside of the case with the outside of the case, for heat exchange between a fluid and the condenser and the compressor, and the generator unit outputs the sound signal having the frequency toward the communication portion. For example, the communication portion includes one or more openings that are defined at one or more surfaces of the case and configured to communicate air between the inside of the case and the outside of the case The case may include a first side surface, and a second side surface formed at a position opposing the first side surface, apart from the first side surface. The communication portion may include a first communication portion formed on the first side surface, and a second communication portion formed on the second side surface.

The refrigerator machine room may further include a fan between the first communication portion and the second communication portion, to generate an air flow.

The compressor may be located between the first communication portion and the fan, and the condenser may be located between the second communication portion and the fan.

The generator unit may include a first generator facing the first side surface and configured to emit the frequency toward the first side surface, and a second generator facing the second side surface and configured to emit the frequency toward the second side surface.

The first generator and the second generator may be provided in a straight line.

Alternatively, the first generator and the second generator may be located adjacent to the compressor.

The case may further include a rear surface connecting the first side surface and the second side surface to each other, and the communication portion may further include a third communication portion formed on the rear surface.

The compressor may be located between the first communication portion and the third communication portion.

According to an embodiment of the disclosure, a refrigerator includes a body including a storage room therein, and a machine room located under the storage room. The machine room includes a case accommodating a condenser and a compressor therein, a sensing unit provided inside the case and configured to measure noise from the compressor, and a generator unit provided inside the case and configured to output a sound signal having a frequency canceling the noise measured from the compressor. A communication portion is formed in the case to communicate the inside of the case with the outside of the case, for heat exchange between a fluid and the condenser and the compressor. The case includes a first side surface, and a second side surface formed at a position opposing the first side surface, apart from the first side surface. The communication portion includes a first communication portion formed on the first side surface, and a second communication portion formed on the second side surface.

The sensing unit may include a first microphone located on the first communication portion, and a second microphone located on the second communication portion.

The compressor and the condenser may be located apart from each other, and the refrigerator may further include a partition located between the compressor and the condenser, to divide a first space in which the compressor is located and a second space in the condenser is located.

A fan may be provided in the partition, to generate an air flow.

The first generator and the second generator may be located adjacent to the compressor, in parallel to the rear surface.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Figure 1:
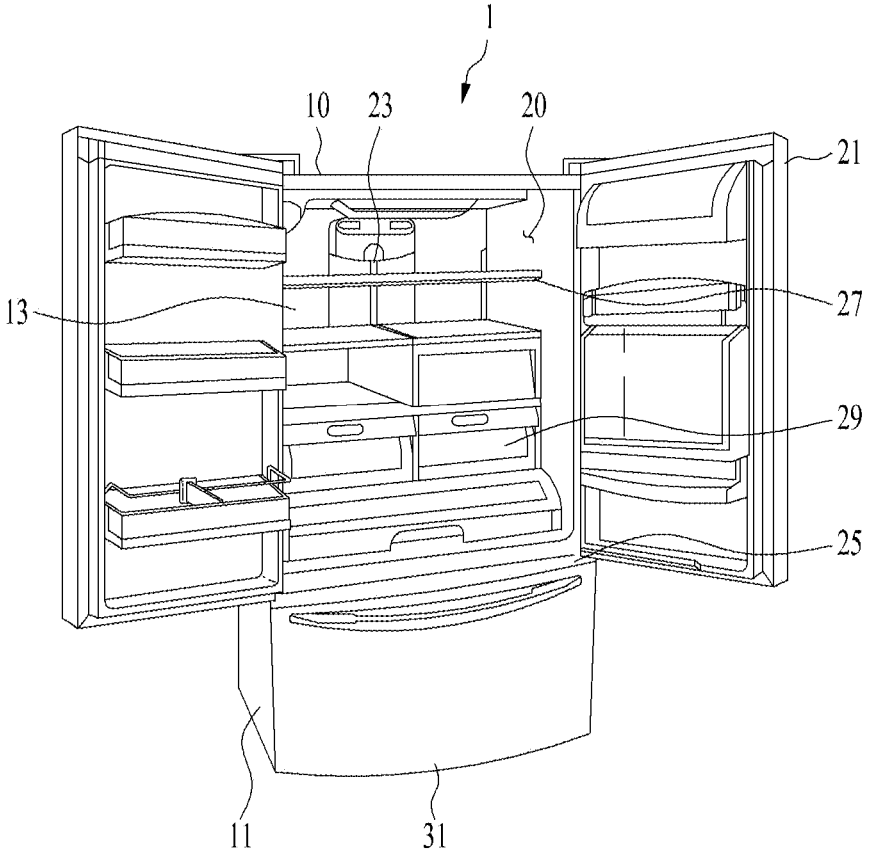
FIG. 1 is a perspective view illustrating a conventional refrigerator.

Reference will now be made in detail to a conventional technology and a preferred embodiment of the present disclosure, examples of which are illustrated in the accompanying drawings.

The sizes or shapes of components may be shown as exaggerated in the drawings, for the clarity and convenience of description. Further, the terms as set forth herein are defined in consideration of the configuration and operation of the present disclosure, and they may be different according to the intent of a user or an operator or customs.

Terms such as first and/or second may be used to describe various components, no limiting the components. The terms are only for the purpose of distinguishing one component from other components. For example, a first component may be referred to as a second component, or vice versa without departing from the scope and spirit of the present disclosure.

These terms should be defined based on the overall disclosure.

A conventional refrigerator will be described with reference to FIGS. 1, 2 and 3.

Figure 2:
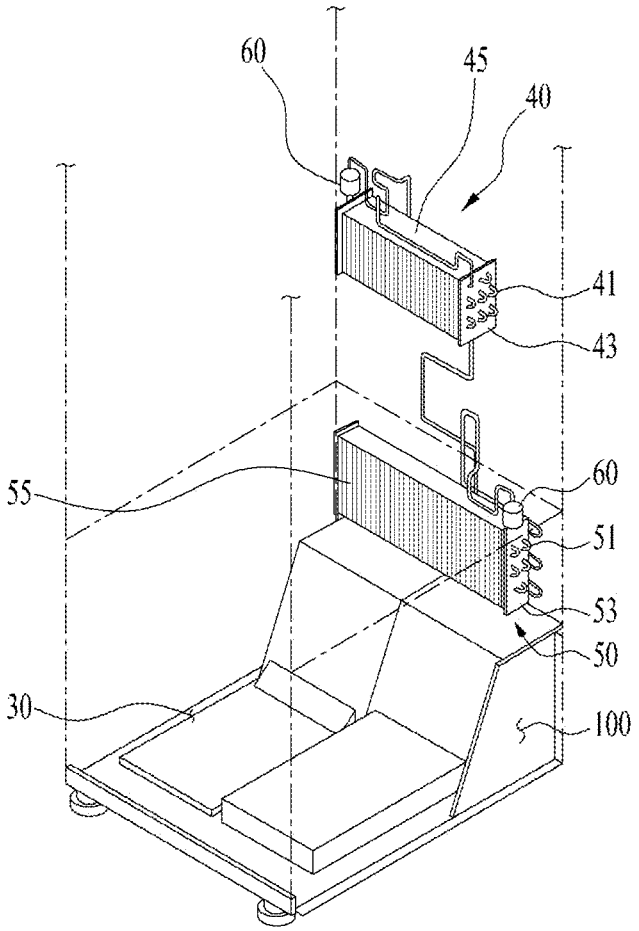
FIG. 2 is a diagram illustrating the interior of a body of the conventional refrigerator.
Figure 3:
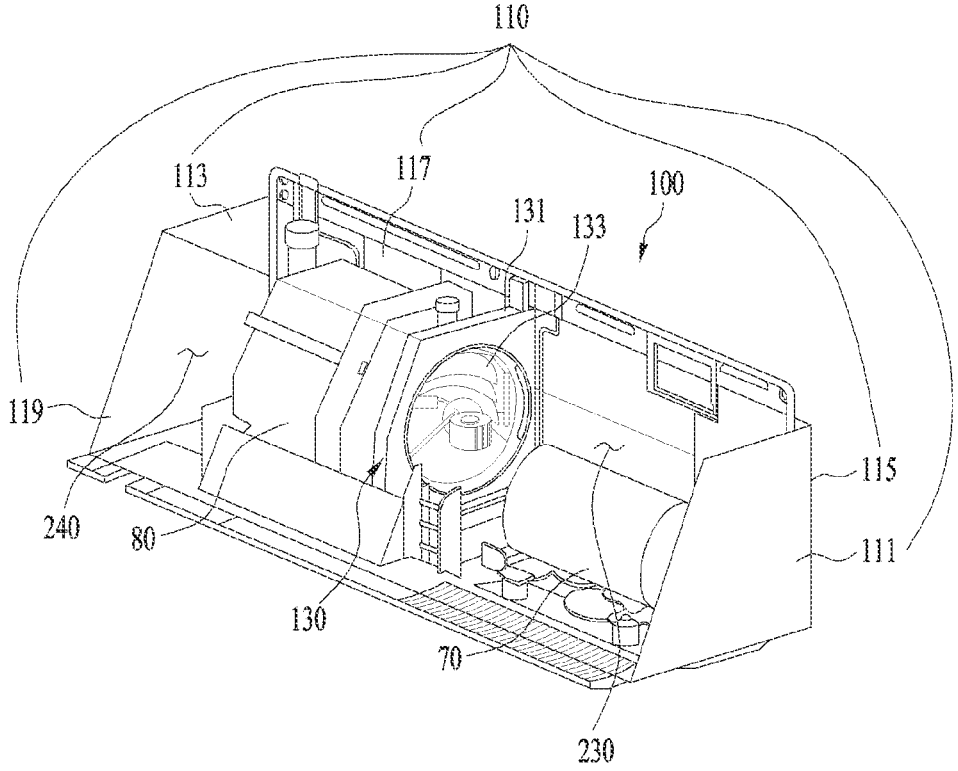
FIG. 3 is a diagram illustrating a machine room in the conventional refrigerator.

FIG. 1 is a diagram illustrating a conventional refrigerator, FIG. 2 is a diagram illustrating the interior of a body of the conventional refrigerator, and FIG. 3 is a diagram illustrating a machine room in the conventional refrigerator.

Referring to FIG. 1, a refrigerator 1 includes a body 10 which forms the exterior of the refrigerator 1 and includes a storage room therein.

The body 10 includes an outer case 11 forming the exterior of the refrigerator 1 and an inner case 13 forming the storage room.

The storage room includes a refrigerator compartment 20 that forms a space for storing food at a low temperature and a freezer compartment 30 for storing or freezing food at a lower temperature than the refrigerator compartment 20.

The refrigerator compartment 20 and the freezer compartment 30 may be separated by a partition wall 25 crossing the interior of the body 10. As illustrated in FIG. 1, the refrigerator compartment 20 may be formed in a space on the partition wall 25, and the freezer compartment 30 may be formed in a space under the partition wall 25, which should not be construed as limiting the present disclosure. Obviously, the freezer compartment 30 may be formed in the space on the partition wall 25, and the refrigerator compartment 20 may be formed in the space under the partition wall 25.

The refrigerator compartment 20 is provided with a cold air discharger 23 for discharging cold air to the refrigerator compartment 20. The cold air discharger 23 may be formed on the rear wall of the refrigerator compartment 20.

While not shown, a cold air discharger for discharging cold air to the freezer compartment 30 may also be formed on the rear wall of the freezer compartment 30.

In order to preserve the cold air supplied to the refrigerator compartment 20 and the freezer compartment 30, doors 21 and 31 for shielding the refrigerator compartment 20 and the freezer compartment 30, respectively are provided.

The refrigerator compartment door 21 shielding the refrigerator compartment 20 is hingedly coupled to the body 10, rotatably with respect to the body 10. Further, the freezer compartment door 31 shielding the freezer compartment 30 may be configured as a drawer type to be pulled out forward.

Further, for efficient use of the space of the storage room, a plurality of shelves 27 and a plurality of drawers 29 are provided inside the body 10, dividing the space of the storage room into a plurality of spaces.

Referring to FIG. 2, first and second evaporators 40 and 50 are provided inside the body 10, to supply cold air to the storage room.

The first evaporator 40 that supplies cold air to the refrigerator compartment 20 in communication with the refrigerator compartment 20 includes a first refrigerant tube 41, a first fixing bracket 43, and a first pin 45.

The first fin 45 is coupled with the first refrigerant tube 41 through which a refrigerant flows, to increase a heat exchange area of the fluid. Further, the first fixing bracket 43 fixes the first refrigerant tube 41.

The second evaporator 50 that supplies cold air to the freezer compartment 30 in communication with the freezer compartment 30 includes a second refrigerant tube 51, a second fixing bracket 53, and a second pin 55.

The second fin 55 is coupled with the second refrigerant tube 51 through which the refrigerant flows, to increase the heat exchange area of the fluid. Further, the second fixing bracket 53 fixes the second refrigerant tube 51.

Accordingly, cold air generated from the evaporators 40 and 50 is supplied to the storage room through the cold air dischargers 23. The refrigerant flowing through the evaporators 40 and 50 is vaporized and supplied to the compressor.

However, a refrigerant which has not been vaporized and thus remains in a liquid state out of the refrigerant flowing through the evaporators 40 and 50 should be prevented from flowing to the compressor.

For this purpose, the refrigerant flowing through the evaporators 40 and 50 is supplied to the compressor through gas-liquid separators 60 that supply only a gaseous refrigerant out of the liquid refrigerant and the gaseous refrigerant to the compressor.

A machine room 100 may be provided under the storage room. When the machine room 100 is located under the storage room, the compressor and the condenser may be provided inside the machine room 100.

On the contrary, when the machine room 100 is located on the storage room, an evaporator and the compressor may be provided inside the machine room 100. When the compressor is provided in the machine room 100, it is necessary to block noise generated from the compressor.

Referring to FIG. 3, the machine room 100 may include a case 110 to block noise generated from a compressor 70.

The case 110 may accommodate the compressor 70 and a condenser 80 therein and separate the storage room 20 and 30 from the machine room 100.

For this purpose, the case 110 may include a first side surface 111 forming a side of the case 110 and a second side surface 113 facing the first side surface 111, apart from the first side surface 111.

The case 110 may further include a rear surface 115 that connects one side of the first side surface 111 to one side of the second side surface 113, forming the rear of the machine room 100.

The case 110 may further include a front surface 119 facing the rear surface 115, apart from the rear surface 115 and a top surface 117 forming the top of the machine room 100 by connecting the front surface 119 to the rear surface 115.

Accordingly, noise generated from the inside of the machine room 100 may be blocked by the case 110, and the case 110 may form the exterior of the machine room 100.

The compressor 70 and the condenser 80 may be located inside the case 110, apart from each other. A partition 130 may be located between the compressor 70 and the condenser 80 to divide a first space 230 accommodating the compressor 70 and a second space 240 accommodating the condenser 80.

The partition 130 may be provided at a position opposing the side surfaces 111 and 113 or at a position parallel to the side surfaces 111 and 113. In other words, the partition 130 may face the first side surface 111 and the second side surface 113. That is, the partition 130 may be interposed between the first side surface 111 and the second side surface 113, facing the first side surface 111 and the second side surface 113.

The partition 130 may include a fan 133 forming an air flow and a fan housing 131 accommodating the fan 133.

The fan 133 may generate an air flow so that the compressor 70 and the condenser 80 may exchange heat with air smoothly. For this purpose, a plurality of through holes may be formed on the rear surface 115 to communicate the inside and outside of the machine room 100 with each other.

However, a plurality of through holes are preferably not formed on the first side surface 111 and the second side surface 113. This is because formation of a plurality of through holes on the first side surface 111 and the second side surface 113 may leak air and noise generated from the compressor 70 to the outside of the machine room 100.

The rear surface 115 usually opposes the wall of a space in which the refrigerator 1 is installed. Therefore, even though noise leaks through the rear surface 115, the noise may be blocked by the wall.

However, air and noise leaked through the side surfaces 111 and 113 of the machine room 100 are generally difficult to block by the wall.

In this case, the compressor 70 and the condenser 80 are not sufficiently cooled. The degree to which the compressor 70 and the condenser 80 are cooled leads to the efficiency of the compressor 70 and the condenser 80, which may in turn lead to the efficiency of the refrigerator 1.

In this context, an embodiment of the present disclosure may provide a refrigerator equipped with a noise reduction device 200.

Figure 4:
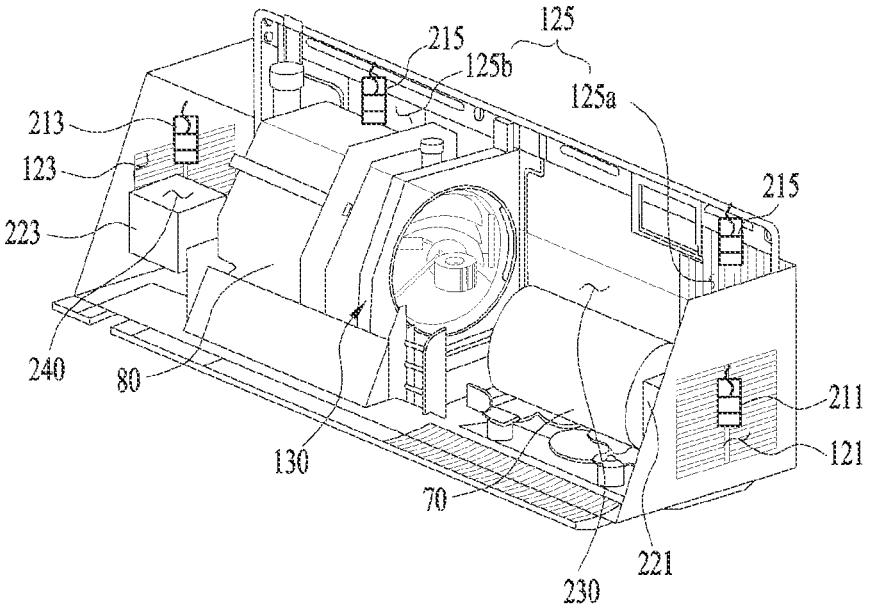
FIG. 4 is a diagram illustrating a machine room according to an embodiment of the present disclosure.

With reference to FIG. 4, a machine room 100 equipped with the noise reduction device 200 according to an embodiment of the present disclosure will be described.

However, since the machine room 100 illustrated in FIG. 4 is identical to the conventional machine room 100 described above with reference to FIGS. 1 to 3, the machine room 100 will not be described again to avoid redundancy.

The noise reduction device 200 according to an embodiment of the present disclosure may include a sensing unit 210 that measures the internal noise of the machine room 100 and a generator unit 220 that emits noise that cancels the internal noise of the machine room 100.

The sensing unit 210 may measure noise generated from the compressor 70 or the fan 133. However, the noise measurement may be different depending on the position of the sensing unit 210 in the machine room 100. For example, the sensing unit 210 can include one or more sensors or electric circuits.

For example, when the sensing unit 210 is located adjacent to the compressor 70, the sensing unit 210 may mainly measure noise generated from the compressor 70. However, when the sensing unit 210 is located adjacent to the fan 133, the sensing unit 210 may mainly measure noise generated from the fan 133.

Therefore, a plurality of sensing units 210 are preferably provided.

Accordingly, the sensing units 210 may include a first microphone 211 located on the first side surface 111 and a second microphone 213 located on the second side surface 113.

The first microphone 211 is located on the first side surface 111, preferably on the inner surface of the first side surface 111. This is because when the first microphone 211 is located on the outer surface of the first side surface 111, noise generated from the inside of the machine room 100 may not be accurately measured.

Likewise, the second microphone 213 is preferably located on the inner surface of the second side surface 113.

The sensing units 210 may further include a third microphone 215 formed on the rear surface 115.

As such, the plurality of sensing units 211, 213, and 215 may be provided to accurately measure noise generated inside the machine room 100.

To cancel the noise measured by the sensing units 210, the generator unit 220 may emit noise canceling the noise measured by the sensing units 210.

Particularly, when the generator unit 220 cancels noise leaking through the first side surface 111 and the second side surface 113 which are easily exposed to the outside, communication portions 121, 123, and 125 may be formed on the first side surface 111 and the second side surface 113 to allow external air which may cool the compressor 70 and the condenser 80 to enter and exit.

Accordingly, a plurality of communication portions 121, 123, and 125 may be formed in the machine room 100 with the noise reduction device 200 according to an embodiment of the present disclosure.

The communication portions 121, 123, and 125 may penetrate through the case 110 to communicate the inside of the case 110 with the outside of the case 110. Each communication portion 121, 123, and 125 may be configured in various shapes, preferably with a plurality of through holes formed thereon.

Accordingly, the communication portions 121, 123, and 125 may include a first communication portion 121 formed on the first side surface 111, a second communication portion 123 formed on the second side surface 113, and third communication portions 125 formed on the rear surface 115. That is, compared to the conventional technology in which a plurality of through holes are formed on the rear surface 115 to prevent noise generated inside the machine room 100 from leaking to the outside of the machine room 100, the plurality of communication portions 121, 123, and 125 may be formed in the machine room 100 according to an embodiment of the present disclosure.

Further, the third communication portions 125 may include a third communication portion 125*a* formed in the first space 230 accommodating the compressor 70 and a third communication portion 125*b* in the second space 240 accommodating the condenser 80.

Accordingly, the generator unit 220 may be disposed such that noise generated inside the machine room 100 does not leak through the first side surface 111 and the second side surface 113.

For this purpose, the generator unit 220 may include a first speaker 221 at a position opposing the first side surface 111 and a second speaker 223 at a position opposing the second side surface 113.

In other words, the first speaker 221 may be provided in the first space 230 accommodating the compressor 70, between the compressor 70 and the first side surface 111 to emit noise toward the first side surface 111.

Similarly, the second speaker 223 may be provided in the second space 240 accommodating the condenser 80, between the condenser 80 and the second side surface 113 to emit noise toward the second side surface 113.

Further, the first microphone 211 may be located on the first communication portion 121 of the first side surface 111 to measure noise leaked from the first communication portion 121. Similarly, the second microphone 213 may be located on the second communication portion 123 of the second side surface 113 to measure noise leaked from the second communication portion 123.

In this manner, the sensing units 210 may thoroughly measure the noise leaked through the communication portions 121, 123, and 125 out of the noise generated inside the machine room 100, and the generator unit 220 may cancel the noise leaked through the communication portions 121, 123, and 125 out of the noise generated inside the machine room 100.

Accordingly, the compressor 70 and the condenser 80 may be efficiently cooled, while noise generated inside the machine room 100 is reduced.

Figure 5A:
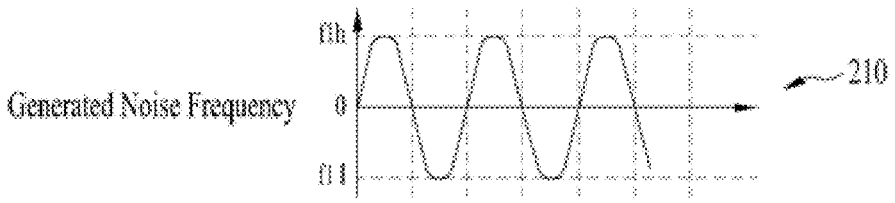
FIGS. 5A to 5C are diagrams illustrating a noise reduction principle according to an embodiment of the present disclosure.
Figure 5B:
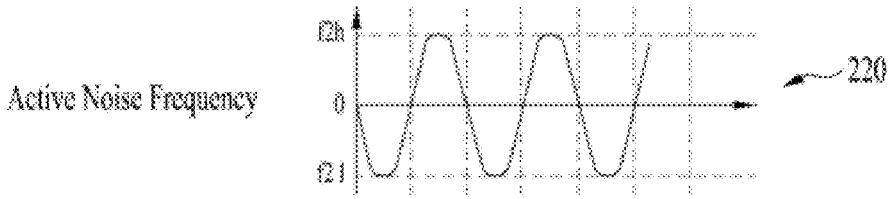
Figure 5C:
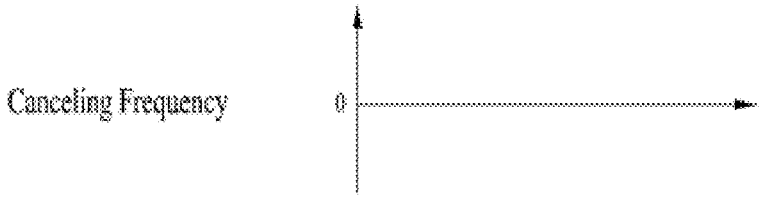
Figure 6:
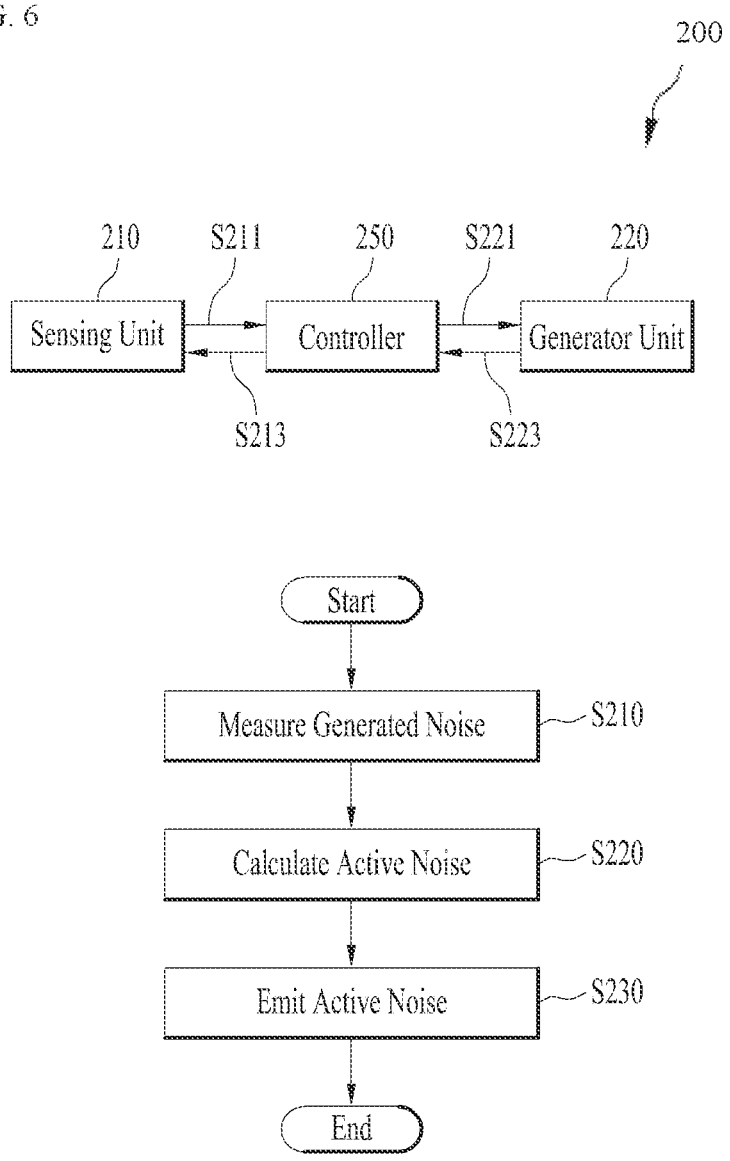
FIG. 6 is a block diagram illustrating a noise reduction device and a flowchart illustrating an operation of the noise reduction device according to an embodiment of the present disclosure.

With reference to FIGS. 5A to 6, an operation of the noise reduction device 200 according to an embodiment of the present disclosure will be described below.

FIGS. 5A to 5C are diagrams illustrating a noise reduction principle according to an embodiment of the present disclosure, and FIG. 6 is a block diagram illustrating the noise reduction device 200 and a flowchart illustrating an operation of the noise reduction device 200 according to an embodiment of the present disclosure.

As illustrated in FIG. 5A, noise generated inside the machine room 100 may be measured in the form of a frequency that vibrates between f1*h* and f1*l* by the sensing units 210. However, the noise in the frequency form illustrated in FIG. 5A is merely exemplary, and even through the noise is in any other form than the frequency illustrated in FIG. 5A, the nose may be canceled by the generator unit 220.

As illustrated in FIG. 5B, the generator unit 220 emits a frequency that cancels the frequency of the noise generated inside the machine room 100. The frequency emitted from the generator unit 220 may have a phase difference of 180 degrees from the frequency illustrated in FIG. 5A.

That is, the frequency vibrating between f2*h* and f2*l* emitted from the generator unit 220 is identical to the frequency illustrated in FIG. 5A in terms of frequency, amplitude, and period, only with a phase difference between them.

Accordingly, the frequency measured by the sensing units 210 may be canceled by the frequency emitted from the generator unit 220, as illustrated in FIG. 5C.

Referring to FIG. 6, the noise reduction device 200 according to an embodiment of the present disclosure may include a controller 250 that transmits information between a sensing unit 210 and the generator unit 220.

The sensing unit 210 may measure noise generated inside the machine room 100 (S210) and transmit the noise measurement to the controller 250 (S211). The controller 250 may analyze and calculate the frequency of the noise measurement received from the sensing unit 210 (S220), and transmit information about a frequency that cancels the calculated frequency to the generator unit 220 (S221). The generator unit 220 may receive the information about the canceling frequency from the controller 250 and emit the canceling frequency (S230).

In this case, the generator unit 220 may transmit information about the emitted frequency to the controller 250 (S223), and the controller 250 may transmit the calculated frequency to the sensing unit 210 (S213).

However, the sensing unit 210 and the generator unit 220 may transmit and receive information to and from each other without intervention from the controller 250.

That is, the sensing unit 210 may measure noise generated inside the machine room 100 (S210), and transmit a frequency related to the noise measurement to the generator unit 220 without passing through the controller 250.

As such, the generator unit 220 may generate a frequency with a phase difference from the frequency of the noise measured by the sensing unit 210, thereby canceling the noise generated inside the machine room 100.

Now, the noise reduction device 200 for efficiently reducing noise generated by the compressor 70 according to an embodiment of the present disclosure will be described with reference to FIGS. 7 and 8.

Figure 7:
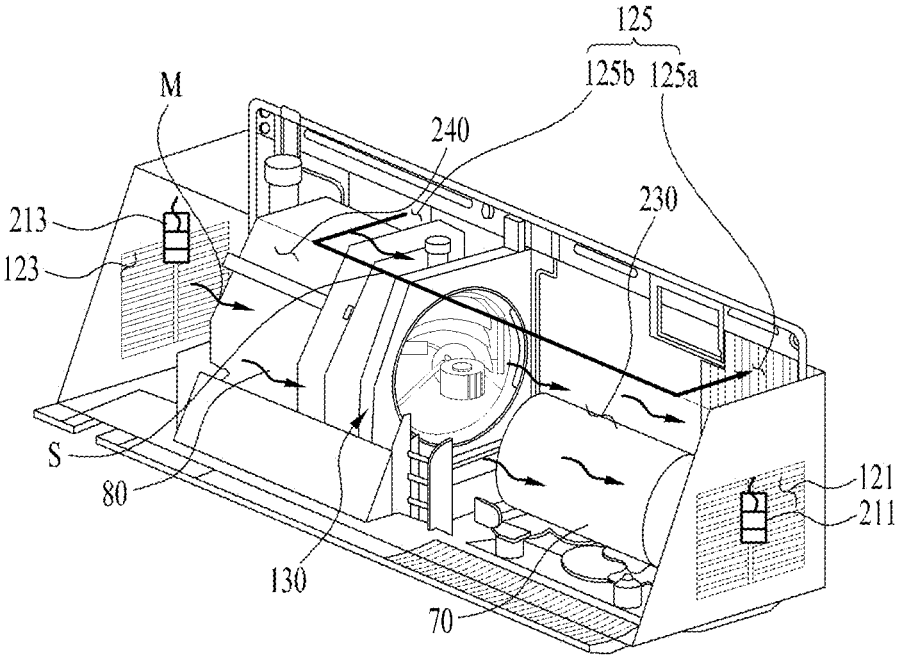
FIG. 7 is a diagram illustrating a generator unit according to an embodiment of the present disclosure.
Figure 8:
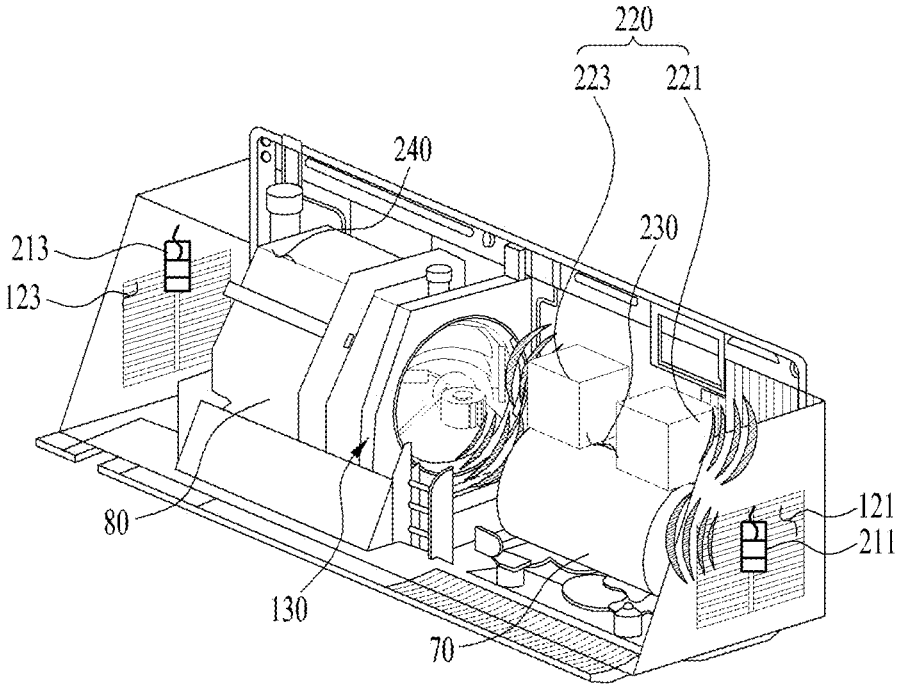
FIG. 8 is a diagram illustrating a frequency inside a machine room according to an embodiment of the present disclosure.

FIG. 7 is a diagram illustrating the generator unit 220 according to an embodiment of the present disclosure, and FIG. 8 is a diagram showing a frequency inside the machine room according to an embodiment of the present disclosure.

As described before with reference to FIG. 4, when the first speaker 221 is provided between the compressor 70 and the first side surface 111, and the second speaker 223 is provided between the condenser 80 and the second side surface 113, noise generated from the compressor 70 may not be intensively canceled.

This is because the second speaker 223 is located not in the first space 230 accommodating the compressor 70 but in the second space 240 accommodating the condenser 80.

However, since the compressor 70 may be regarded as a main noise source inside the machine room 100, it is necessary to mainly cancel the noise generated from the compressor 70.

For this purpose, in an embodiment of the present disclosure, the generator unit 220 is located in the first space 230 accommodating the compressor 70.

Further, the generator unit 220 in the first space 230 is preferably located adjacent to the compressor 70. This is because as the generator unit 220 is closer to the compressor 70, the generator unit 220 may cancel the noise generated from the compressor 70 more efficiently.

In other words, it is preferable that the first speaker 221 and the second speaker 223 are located adjacent to the compressor 70. The first speaker 221 or the second speaker 223 may be provided in contact with the compressor 70.

Further, it is preferable that the first speaker 221 and the second speaker 223 emit a frequency that cancels the noise generated from the compressor 70 in directions opposite to each other. That is, the first speaker 221 may be provided toward the first communication portion 121 to emit the frequency to the first communication portion 121. Similarly, it is preferable that the second speaker 223 is provided toward the second communication portion 123 to emit the frequency to the second communication portion 123.

Further, the first speaker 221 and the second speaker 223 are preferably provided on a straight line. As illustrated in FIGS. 7 and 8, this is because when the compressor 70 spans a predetermined length in the horizontal direction of the machine room 100, vibrations of the compressor 70 may be amplified in the horizontal direction, and thus leak the vibrations through the first communication portion 121 and the second communication portion 123.

Accordingly, the straight line may mean a virtual line perpendicular to the first side surface 111 and the second side surface 113 and parallel to the rear surface 115.

Further, the first speaker 221 and the second speaker 223 are preferably positioned above the compressor 70. In other words, the first speaker 221 and the second speaker 223 may be located in a direction away from the bottom surface of the case 110 to which the compressor 70 is fixed.

This is because if the first speaker 221 and the second speaker 223 are located on the bottom surface of the case 110 to which the compressor 70 is fixed, it is difficult to cancel the noise of the compressor 70 leaked into at least one of a space between the compressor 70 and the front surface 119 or a space between the compressor 70 and the rear surface 115.

Therefore, when the first speaker 221 and the second speaker 223 are located above the compressor 70, the noise leaking from the compressor 70 toward the first side surface 111 and the second side surface 113 may be efficiently canceled.

When the sensing units 210 are arranged as such, a plurality of cooling paths may be formed in the machine room 100.

More specifically, the fan 133 may generate an air flow from the second space 240 accommodating the condenser 80 to the first space 230 accommodating the compressor 70. That is, the machine room 100 may form a first cooling path M through which air is introduced from the second communication portion 123 and flows out to the first communication portion 121.

As described above, when the first cooling path M is formed through the side surfaces 111 and 113, the amount of air flowing through the machine room 100 increases, so that the compressor 70 and the condenser 80 may be efficiently cooled.

However, a second cooling path S through which air flows through the third communication portions 125 may be formed inside the machine room 100.

The second cooling path S may include a path through which air is introduced from the third communication portion 125*b* formed in the second space 240 and flows out to the third communication portion 125*a* formed in the first space 230.

In addition, the second cooling path S may include a path through which air introduced from the second communication portion 123 flows out to the third communication portion 125*b* formed in the second space 240, and a path through which air introduced from the second communication portion 123 flows out to the third communication part 125*a* formed in the first space 230.

In this manner, noise generated inside the machine room 100 may be actively canceled. Therefore, a plurality of cooling paths for cooling the compressor 70 and the condenser 80 may be formed in the machine room 100.

Accordingly, as illustrated in FIG. 8, noise directed toward the side surfaces 111 and 113 out of noise generated from the compressor 70 may be canceled by the first speaker 221 and the second speaker 223.

Further, noise which is not directed toward the side surfaces 111 and 113 out of the noise generated from the compressor 70 may be canceled by the front surface 119 and the top surface 117. However, although noise directed toward the rear surface 115 out of the noise generated from the compressor 70 may leak through the third communication portion 125*s*, the noise leaked through the third communication portions 125 may be dissipated by the wall of the space where the refrigerator 1 is installed, as described before.

As is apparent from the foregoing description, according to an embodiment of the present disclosure, in spite of a change in the number of revolutions of a compressor, noise generated from the compressor may be reduced.

According to an embodiment of the present disclosure, a compressor and a condenser may be efficiently cooled, thereby increasing the efficiency of a refrigerator.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A refrigerator machine room comprising:

a case configured to accommodate a condenser and a compressor therein, the case defining a communication portion configured to communicate a fluid between an inside of the case and an outside of the case to thereby exchange heat between (i) the fluid and (ii) the condenser and the compressor;

a sensing unit located at the case and configured to measure noise from the compressor; and a generator unit located at the case and configured to output a sound signal toward the communication portion, the sound signal having a frequency configured to cancel or reduce the noise;

wherein the case comprises:

a first side surface, and a second side surface that is spaced apart from the first side surface and faces the first side surface, wherein the communication portion comprises a first communication portion defined at the first side surface, and a second communication portion defined at the second side surface, and wherein the refrigerator machine room further comprises a fan located between the first communication portion and the second communication portion and configured to generate air flow in the case.

2. The refrigerator machine room according to claim 1, wherein each of the first communication portion and the second communication portion comprises one or more openings configured to communicate air between the inside of the case and the outside of the case.

3. The refrigerator machine room according to claim 1, wherein the case is configured to accommodate the compressor between the first communication portion and the fan, and to accommodate the condenser between the second communication portion and the fan.

4. The refrigerator machine room according to claim 3, wherein the generator unit comprises:

a first generator that faces the first side surface and is configured to output the sound signal toward the first side surface; and a second generator that faces the second side surface and configured to output the sound signal toward the second side surface.

5. The refrigerator machine room according to claim 4, wherein the first generator and the second generator are arranged along a straight line in the case.

6. The refrigerator machine room according to claim 4, wherein the first generator and the second generator are located closer to the compressor than to the condenser.

7. The refrigerator machine room according to claim 1, wherein the case further comprises a rear surface that connects the first side surface and the second side surface to each other, and wherein the communication portion further comprises a third communication portion defined in the rear surface.

8. The refrigerator machine room according to claim 7, wherein the case is configured to accommodate the compressor between the first communication portion and the third communication portion.

9. The refrigerator machine room according to claim 1, wherein the sensing unit comprises one or more microphones configured to detect the noise, and wherein the generation unit comprises one or more speakers that are configured to output the sound signal configured to cancel or reduce the noise.

10. A refrigerator comprising:

a body that defines a storage room therein;

a case that defines a machine room vertically below the storage room;

a condenser and a compressor that are accommodated in the machine room, the case defining a communication portion configured to communicate a fluid between an inside of the case and an outside of the case to thereby exchange heat between (i) the fluid and (ii) the condenser and the compressor;

a sensing unit located at the case and configured to measure noise from the compressor; and a generator unit located at the case and configured to output a sound signal having a frequency configured to cancel or reduce the noise, wherein the communication portion comprises:

a first communication portion defined at a first side surface of the case, and a second communication portion defined at a second side surface of the case that faces the first side surface and is spaced apart from the first side surface, wherein each of the first communication portion and that second communication portion comprises one or more openings configured to communicate air between the inside of the case and the outside of the case, wherein the compressor and the condenser are spaced apart from each other, and wherein the refrigerator further comprises a partition that is located between the compressor and the condenser and that divides the machine room into a first space accommodating the compressor and a second space accommodating the condenser.

11. The refrigerator according to claim 10, wherein the sensing unit comprises:

a first microphone located at the first communication portion; and a second microphone located at the second communication portion.

12. The refrigerator according to claim 10, further comprising a fan located at the partition and configured to generate air flow in the case.

13. The refrigerator according to claim 12, wherein the generator unit comprises:

a first generator located in the first space and configured to output the sound signal toward the first side surface; and a second generator located in the first space and configured to output the sound signal toward the second side surface.

14. The refrigerator according to claim 13, wherein the first generator and the second generator are located at a rear surface of the case and positioned closer to the compressor than to the condenser.

15. The refrigerator according to claim 14, wherein the first generator and the second generator are arranged along a straight line parallel to the rear surface of the case.

16. The refrigerator according to claim 10, wherein the sensing unit comprises one or more microphones configured to detect the noise, and wherein the generation unit comprises one or more speakers that are configured to output the sound signal configured to cancel or reduce the noise.

* * * * *